United States Patent [19]

Bueb et al.

[11] 4,387,476

[45] Jun. 14, 1983

[54] METHOD AND AN APPARATUS FOR A WASHING PROCESS SUBSEQUENT TO THE SPINNING OF SYNTHETIC FIBERS

[75] Inventors: Michael Bueb, Dormagen; Robert Brück, Erftstadt-Ahrem; Edgar Muschelknautz, Leverkusen; Dieter Paulini; Karlheinz Feltgen, both of Dormagen, all of Fed. Rep. of Germany

[73] Assignee: Bayer Aktiengesellschaft, Leverkusen

[21] Appl. No.: 212,052

[22] Filed: Dec. 1, 1980

[30] Foreign Application Priority Data

Dec. 12, 1979 [DE] Fed. Rep. of Germany ..... 2950014

[51] Int. Cl.[3] ..... D06B 5/06

[52] U.S. Cl. ..... 8/151.2; 68/205 R

[58] Field of Search ..... 68/205 R, 3 SS; 8/151, 8/152, 151.2

[56] References Cited

U.S. PATENT DOCUMENTS

| | | | |
|---|---|---|---|
| 2,621,506 | 12/1952 | Hopkins et al. | 68/205 R X |
| 2,817,227 | 12/1957 | Eriksson | 68/205 R X |
| 3,579,679 | 5/1971 | Willis | 68/205 R X |
| 3,922,738 | 12/1975 | Holm | 68/3 SS X |

FOREIGN PATENT DOCUMENTS

| | | | |
|---|---|---|---|
| 215861 | 4/1968 | U.S.S.R. | 68/3 SS |

*Primary Examiner*—Philip R. Coe

*Attorney, Agent, or Firm*—Sprung, Horn, Kramer & Woods

[57] ABSTRACT

In the process of washing synthetic fibers directly subsequent to the spinning process in which the tow is deposited in a folded condition onto a transportation device, the solvent is removed as completely as possible with the use of as little fresh water as possible if the washing process is carried out on the folded tow in counterflow on this transporting device.

3 Claims, 5 Drawing Figures

METHOD AND AN APPARATUS FOR A WASHING PROCESS SUBSEQUENT TO THE SPINNING OF SYNTHETIC FIBERS

This invention relates to a method and an apparatus for carrying out a washing process directly subsequent to the spinning of synthetic fibres.

After being spun, some types of synthetic fibres have to be subjected to a treatment using aqueous media in order to effect required physical-chemical changes in the fibres. This applies, for example, to cellulose synthetic fibres or to synthetic fibres made of polyacrylonitrile, which are produced using a solvent in the dry or wet spinning process.

When spinning polyacrylonitrile fibres according to the dry spinning process, the fibres still contain about 10 to 30% of solvent, e.g. dimethyl formamide, after leaving the spinning shaft. This solvent is usually substantially removed from the fibres by means of an extraction process using water.

In dry spinning, the tows from several spinning shafts are usually collected into one tow and are deposited in a spinning can at rates of between 200 and 400 m/min. Several such tows are then removed from spinning cans positioned next to each other, are combined into one bigger tow and are conveyed at a velocity of from 20 to 70 m/min to a so-called after-treatment path, in which the tows are subjected to different after-treatment steps. One of these after-treatment steps is the washing process or extraction of the solvent.

For ecological and economic reasons, the solvent must be completely removed and recovered from the fibres as early as possible during the production process. For this reason, it is advantageous not to carry out the washing process during the course of the after-treatment, but directly subsequent to spinning.

Because of the residence time needed for the washing process of, for example, from 1 to 10 minutes, which is diffusion-controlled, it is disadvantageous to convey the tow in a stretched condition through a washing apparatus at a rate of from 200 to 400 m/min, because the washing apparatus would then have to have very long overall lengths. In a more expedient manner, the tow is folded or compressed and the tow structure which is produced in this manner is conveyed through the washing apparatus at a reduced rate corresponding to the degree of folding or compressing.

In order to meet these requirements, it is known that washing apparatus can be positioned after the spinning system, in which apparatus the tow is deposited on a transporting support, whereby the rate of transport is slower than the rate of feed.

A washing process is described in German Offenlegungsschrift No. 2,515,410, in which the small tows are deposited onto a transporting support, whereby a liquid layer is produced and held above the transporting support for washing purposes and the liquid automatically flows through the material lying on the support, merely by the effect of gravity. After passing through the washing path, the fibres which are deposited on the support are deposited, unchanged as a cake in pots. A disadvantage of such a method is the fact that in a washing process of this type, carried out in one step, the required quantity of fresh water is several times greater than in a multi-stage counterflow process and removal of the solvent which may be achieved is insufficient. It is also disadvantageous that, at the end of the washing process, the tow cannot be re-accelerated to the spinning velocity, or drawn out smoothly and deposited in this condition, or further treated, e.g. stretched.

A sieve drum washing machine is described in German Offenlegungsschrift No. 2,704,867, in which the transporting support is designed as a sieve drum through which liquid flows from outside inwards. With this type of apparatus as well, the intended multi-stage counterflow guidance of washing water and tow is lacking so that there is a consumption of fresh water which is too high for economic reasons and the solvent is not completely removed. Moreover, the initially formed tow cake is no longer broken up at the end of the washing device i.e. the compressed or folded small tow is not drawn out smoothly again.

The invention is based on the object of carrying out a washing process directly subsequent to spinning, whereby the tow which is supplied at the spinning rate is initially folded or compressed at the entry of the washing apparatus. Thereby, the solvent should be removed as completely as possible with the use of as little fresh water as possible.

This object is achieved according to the invention in that the tow is deposited on a transporting support in a folded or compressed condition and the washing process is carried out on the folded silver in counterflow on this transporting device.

In order to facilitate a further after-treatment of the washed tows, after leaving the washing path, the tow is preferably drawn out smoothly again and dehydrated using a squeezing device.

The washed and dehydrated tow may then be initially deposited in a spinning can and removed from there in a later step, any may be conveyed to further after-treatment steps, e.g. stretching, drying, crimping steps etc.

In another embodiment of the invention, the washed and dehydrated tow is continuously and directly subjected to other after-treatment steps, e.g. a stretching process.

Therefore, the washing method according to the invention is preferably carried out so that the process is effected in several stages, whereby in each stage washing liquid is sprayed onto the folded tow, the liquid mostly trickles through the tow and the transporting device during the stage and is then collected in a receiver below the transporting device and is returned repeatedly in the same stage while the two is sprayed.

Thereby, within each stage, and before entering into the next stage after spraying, the tow passes through a region in which it is dehydrated, e.g by simply allowing the water to drip off or by means of mechanical dehydration devices, e.g. squeezing devices, or by pneumatic dehydration devices, e.g. air-current devices or vacuum chambers below the transportation device.

The invention also relates to an apparatus for carrying out this method.

The advantages obtained by the invention particularly consist in the fact that the washing process may be carried out subsequent to spinning with a relatively simple apparatus which is reliable in operation. Due to the counterflow guidance in several stages, the necessary specific quantity of fresh water is relatively low. By using the method according to the invention, the solvent is completely removed and recovered from the tows in good time. As a result of this, ecological advantages in respect of protection of labour and environmental protection are obtained in connection with the impervious enclosure of the apparatus which is made possible by the principle of the method.

The invention is illustrated by means of the following drawings and is described in more detail in the following.

Figure 1:
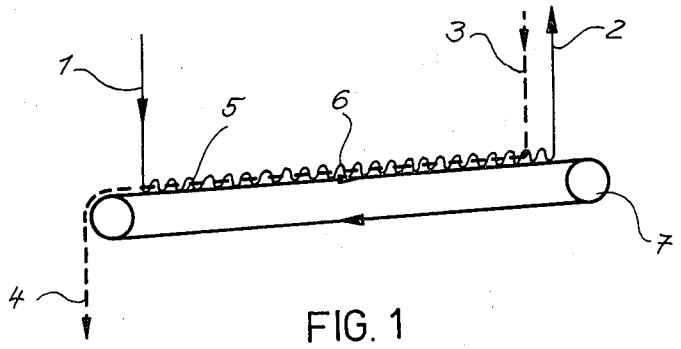
FIG. 1 shows a diagram of a simple counter-flow washing process.

FIG. 1 schematically shows a counter-flow washing process in a very simple form. The tow 1 is deposited, folded, on a conveyor belt 5 which is impermeable to liquid. The tow cake 6 is transported at a slight angle upwards. In counter-flow to the tow cake, the washing liquid flows through or trickles through the silver cake under the effect of gravity. The washed tow 2 leaves the washing apparatus again in a stretched form. The fresh water 3 flows through the tow cake 6, is concentrated with solvent on its path through the tow cake and leaves the washing apparatus as washing water 4. The washing success of the method will be dependent on the constructive implementation and the dimensions, e.g. the length of such a washing apparatus, and also on the selected parameters of the method, e.g. quantity ratios, residence times etc.

It may be disadvantageous in such a washing apparatus if the washing liquid flows past the tow cake laterally or in channels and/or if too much washing liquid in the counterflow is carried along by the tow cake. In this manner, the liquids are mixed longitudinally over the length of the apparatus and the counterflow effect is reduced.

Figure 2:
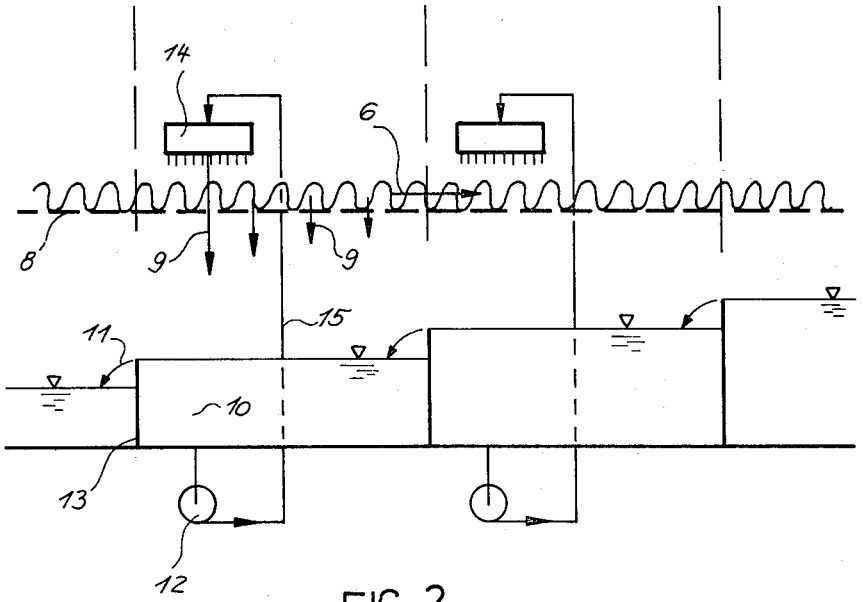
FIG. 2 shows a diagram of a multi-stage counter-flow washing process with washing water which is circulated within the stage.

For these reasons, it is advantageous to direct the washing liquid as shown in the diagram of FIG. 2. In this case, the tow cake 6 is conveyed on a transporting support 8, which is permeable to liquid, through several washing stages which are connected in tandem. Within each stage, washing water is sprayed onto the tow cake from a liquid distributor 14. The washing water 9 trickles through the tow cake and through the support 8 and drips into the receiver 10. The washing liquid is pumped out of this receiver by a pump 12 and returned to the liquid distributor 14.

Within each stage, the tow cake 6 has to be dehydrated before it passes into the next stage in order to avoid longitudinal mixing or re-mixing within the apparatus. In the simplest case, this is effected by allowing the water to drip off. In this manner, the liquid content of the tow cake is reduced to about 1 to 3 kg liquid/kg dry fibres. By means of other mechanical dehydration auxiliary devices, e.g. squeezing and suction devices etc, the quantity of the liquid which is carried along may be further reduced, for example to 0.4 to 2 kg liquid/kg dry fibres.

The washing liquid is conveyed in counter-flow to the tow cake. The washing liquid 11 flows over the over-flow weir 13 from the receiver of each stage into the next stage. The re-pumped quantity of liquid 15 is greater, for example, by from 1 to 10 times, than the quantity of the washing liquid 11. The quantity of the re-pumped washing liquid 15 is greater, for example, by from 3 to 30 times, than the quantity of tow cake (based on dry substances).

The rate of travel of the tow cake is for example from 0.5 to 5 m/min, and the time it remains within a stage is for example from 5 to 300 s. The temperature of the washing water is in the range of from 60° to 100° C.

Figure 3:
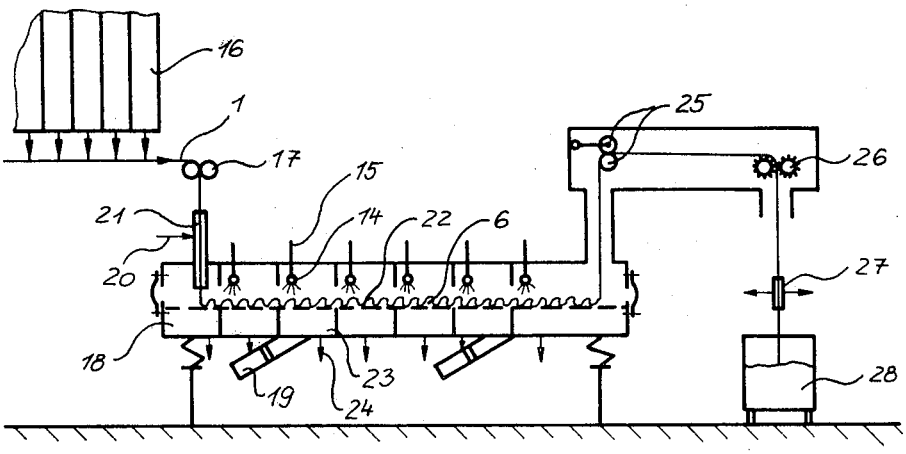
FIG. 3 shows a diagram of the washing process according to the invention subsequent to spinning.

FIG. 3 shows a diagram of the washing process according to the invention subsequent to the dry spinning of synthetic fibres. The tow 1 is drawn off from the spinning shafts 16 by draw-off rollers 17 and is conveyed to the washing apparatus 18 at a rate of from 100 to 400 m/min. The washing apparatus consists, for example, of a vibrating conveyor which is actuated by electromagnetic oscillators 19, and which conveys the tow cake through the washing apparatus at a rate of from 0.5 to 5 m/min. Instead of the electromagnetic oscillators, mechanical out-of-balance type actuators may also be used. There is usually a prejudice against using a vibrating conveyor as the transporting support in the sense that vibrating conveyors are unsuitable for the transport of light-elastic materials, e.g. loose fibres.

Surprisingly, however, it has been found that wet fibres with a water content of from 0.5 to 3 kg water/kg dry fibres may be conveyed.

The vibrating frequency of such a vibrating conveyor is for example n=from 10 to 50 Hz, the vibrating width from 0.4 to 4 mm and the vibrating angle from 20° to 40°.

As an alternative to the vibrating transport, the tow cake may also be conveyed through the washing apparatus on a wire belt or a screen belt. The tow is deposited on the base 22 of the vibrating conveyor, which is permeable to liquid, in compressed or folded form. The degree of compression or folding is, for example, from 10 to 800 and is obtained from the ratio of the rate of delivery (from 100 to 400 m/min) to the transporting rate in the washing apparatus (from 0.5 to 5 m/min). The base 22 may consist, for example, of a perforated plate, a wire fabric or slotted sheet metal having a free cross-sectional area of from 10 to 50%. The tows are expediently deposited using a traversing device 21 which distributes the tow regularly over the working width of the washing apparatus and in which washing liquid 20 is advantageously fed in to convey and rinse the tow. The washing apparatus is divided into several stages corresponding to the diagram of principle in FIG. 2. Washing water 15 is sprayed onto the tow cakes via liquid distributors 14 in the form of sprays or nozzles, the washing water trickles through the cake and is conveyed to the washing water cascade which is located separately, for example according to FIG. 4, through tubs 23 and discharge connections 24. The liquid distributors 14 are respectively positioned within the first half of the individual stages, corresponding to FIG. 2. The sprayed water in the form of streams or drops must only have a relatively low impact velocity on the tow cake of from 0.1 to 1.5 m/s, so that no tangled points are produced in the tow cake. For this reason, the liquid distributor 14 should be positioned as close as possible, e.g. at a distance of from 5 to 15 cm, above the tow cake. For example, within one stage, from 1 to 10 $m^3/h$ of washing liquid are sprayed onto the tow cake. The specific liquid load, i.e. the sprayed quantity of liquid/area of two cake is approximately (5 to 50 $m^3/h.m^2$).

After the tow cake has passed through the washing stages, the tow is again drawn out smoothly and is conveyed through the pair of squeezing rollers 25. The quantity of liquid which has been squeezed out is returned to the washing apparatus. By means of take-off rollers 26 and a panelling-in device 27, the washed tow may be deposited in a spinning can 28, if it is not directly subjected to other treatment steps, e.g. stretching.

Figure 4:
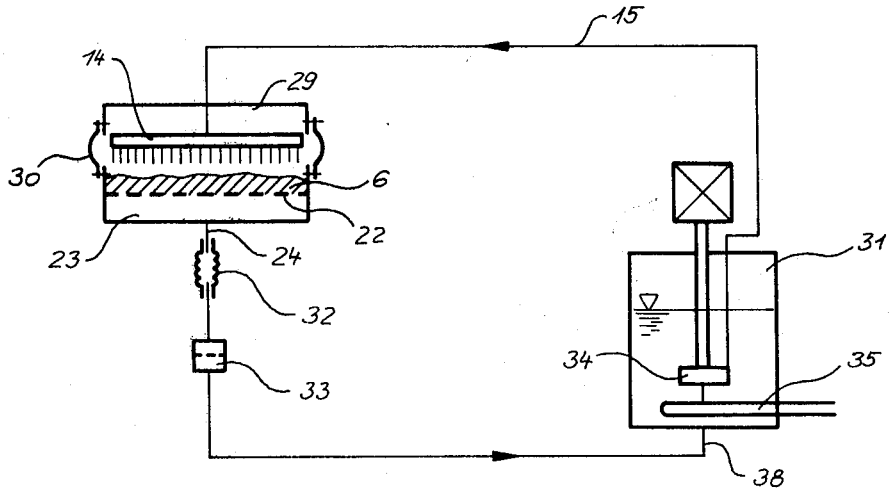
FIG. 4 shows a cross section through the washing apparatus according to the invention and the washing water cascade.

FIG. 4 shows a cross section through the washing apparatus and the washing water cascade. The washing apparatus is sealed off by a hood 29 in order to prevent steam from escaping. The hood 29 may either be connected rigidily to the lower part 23 of the vibrating conveyor and may also vibrate or may be separated vibration-wise e.g. using elastic aprons 30.

The liquid flowing out of the tub 23 through the connections 24 flows back into the washing water cascade 31. In order to ensure that the vibrating conveyor vibrates unrestrictedly, it is advisable to position an elastic intermediate connection 32 downstream of the connection 24. Impurities in the washing water may be removed from the circuit, for example by using a filter device 33.

The washing water is conveyed out of the washing water cascade to the liquid distributor 14 by means of a pump 34.

In order that the temperature of the washing water is brought to and maintained at the required level of e.g. from 80° to 90° C., heating devices are provided in the washing water cascade. For example, these may be designed in the form of steam-heated heating coils 35.

Figure 5:
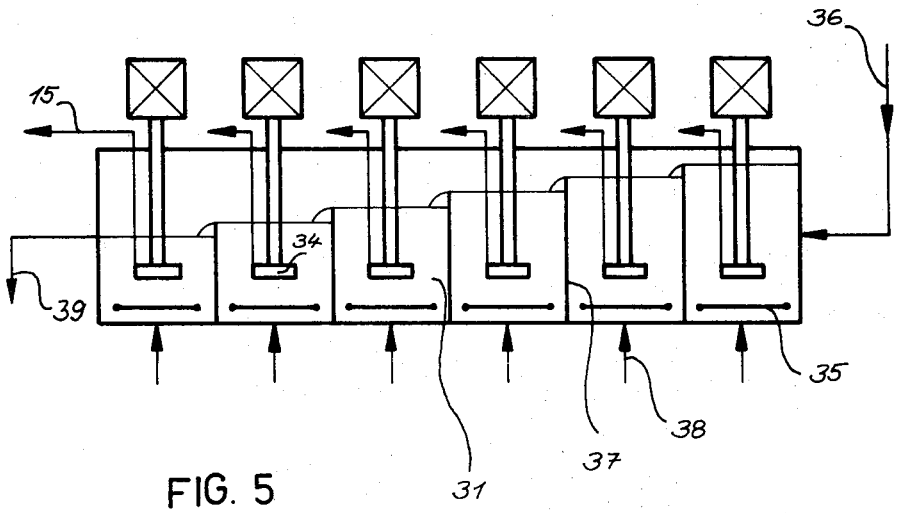
FIG. 5 shows a longitudinal section through the washing water cascade.

FIG. 5 shows a cross section through the washing water cascade. Fresh water is fed into the washing water cascade through the supply pipe 36. The ratio of the quantity of fresh water to the quantity of fibres carried through (dry substances) is, for example, from 0.5 to 3. The cascade comprises containers whose dividing walls 37 are designed as overflow weirs, over which the washing water flows from one stage to another.

Within a stage, a circuit flow is produced in that washing water 15 is conveyed to the distributor 14 by the pumps 34 and the washing water which flows through the tow cake 6 is returned into the cascade by the supply pipe 38.

The number of stages required in the washing water cascade may be, for example, from 10 to 30 stages, according to the washing result which is to be attained and the quantity of fresh water/quantity of fibres to be washed which is to be used. The washing water is concentrated with solvent in counterflow to the tow cake and leaves the washing water cascade through the pipe line 39.

EXAMPLE

A dry-spun tow made of polyacrylonitrile having a tow weight of 20 g/m is introduced, after spinning, into a washing apparatus according to the invention at 300 m/min. The tow has a solvent content of approximately 0.2 kg of dimethyl formamide/kg dry fibres. The tow is deposited in zig-zag fashion in a ratio of 1:100 and passes through the washing apparatus as a tow cake at 3 m/min. The washing apparatus is designed as a vibrating conveyor having a working surface of 1 m in width and 12 m in length and has 20 washing stages. The quantity of fresh water which is supplied is 400 kg/h; the quantity of water which is sprayed onto the tow within each stage is 3 $m^3$/h. The temperature of the washing water was set at 90° C. The washed and squeezed out tow has a residual content of solvent of 0.01 kg of dimethyl formamide/kg dry fibres.

We claim:

1. In a process of washing polyacrylonitrile fibers directly subsequent to a dry spinning process in which the tow is deposited in a folded condition onto a transporting device, the washing is carried out on the folded tow in counterflow on said transporting device in several stages, whereby in each stage washing liquid is sprayed onto the folded tow, the liquid trickles through the tow and through the transporting device within the stage and is then collected in a receiver below the transporting device and is returned repeatedly in the same stage while the tow is sprayed, and the tow before entering into the next stage after spraying, passes in each stage through a region in which it is dehydrated, the improvement wherein the transportation device is a vibrating conveyor which is operated with out-of-balance type drive or electromagnetic actuation, the base of which consists of perforated plates, sieve fabrics or slotted sheet metal with a 10 to 50% free cross sectional area and, according to the covering thickness, impermeable or permeable lateral walls and said folded tow and said conveyor are moved at a rate from 0.5 to 5 meters per minute while being vibrated at a vibrational frequency of 10 to 50 Hz, the tow being deposited on said vibrating conveyor at a rate from 100 to 400 meters per minute.

2. A process according to claim 1, where said base consists of a screen, belt or wire band.

3. A process according to claim 1, wherein the washing liquid is conveyed through the washing apparatus in counterflow to the tow cake by means of a separately positioned washing water container cascade, each stepwise spraying stage having a circulation pump.

* * * * *